US006405402B1

(12) United States Patent
Choi

(10) Patent No.: US 6,405,402 B1
(45) Date of Patent: Jun. 18, 2002

(54) COSMETIC BRUSH ASSEMBLY

(76) Inventor: Man Soo Choi, Hyundai Apartment 301-502 Sa-Dong, Ansan-shi, Kyungki-Do (KR), 425-172

( * ) Notice: Subject to any disclaimer, the term of this patent is extended or adjusted under 35 U.S.C. 154(b) by 34 days.

(21) Appl. No.: 09/699,404

(22) Filed: Oct. 31, 2000

(30) Foreign Application Priority Data

Dec. 1, 1999 (KR) ..... 99-54203

(51) Int. Cl.[7] ..... A46B 15/00
(52) U.S. Cl. ..... 15/184; 401/111
(58) Field of Search ..... 15/160, 184, 201; 401/109, 110, 111, 117

(56) References Cited

U.S. PATENT DOCUMENTS 2,611,915 A * 9/1952 Prokop et al.
2,681,462 A * 6/1954 Turnes
2,887,708 A * 5/1959 Kane
2,913,750 A * 11/1959 Aversa
3,863,288 A * 2/1975 Aversa
4,902,152 A * 2/1990 Seidler
4,966,479 A 10/1990 Idec et al.
5,339,483 A * 8/1994 Byun
5,475,891 A * 12/1995 Rickey
5,813,421 A 9/1998 Wang

* cited by examiner

*Primary Examiner*—Terrence R. Till
(74) *Attorney, Agent, or Firm*—Fish & Richardson P.C.

(57) ABSTRACT

A cosmetic brush assembly includes a first cylindrical member holding bristles, a second cylindrical member, and a protecting cap protecting the bristles. The assembly further includes a brush member, a cylindrical catch member, and a length variable member. The brush member is slidably inserted in the first cylindrical member when it is not used or after use, and can be exposed to the outside of the first cylindrical member by a simple manipulation.

10 Claims, 13 Drawing Sheets

COSMETIC BRUSH ASSEMBLY

BACKGROUND OF THE INVENTION

1. Field of the Invention

The present invention relates to a cosmetic brush assembly having a brush member at its end portion. More particularly, it relates to a cosmetic brush assembly having a brush member with bristles that are inserted into a case and can be exposed to the outside so as to be used for various purposes.

2. Discussion of Related Art

A common-type brush assembly has a cap for protecting bristles mounted on a brush member provided to its end portion. The cap is separated from the body of the brush assembly to expose the brush member to the outside for use, and is rejoined to the body after use so as to house the bristles of the brush member.

If the cap is lost or the brush's bristles are being exposed to the outside, the bristles get damaged or dirty and dust can cling to the bristles, thus interfering with the use of the brush assembly.

Accordingly, a brush assembly, having a brush member held in its body and exposed to the outside when it is used, has been developed. It is preferable that such a brush assembly in use is longer than that in custody. However, this conventional brush assembly becomes complicated in construction, and the exposition of the brush member is not easy.

SUMMARY OF THE INVENTION

Accordingly, an object of the present invention is to provide a cosmetic brush assembly having a brush member that is held in its main body when it is not used or after use, and can be exposed to the outside through simple manipulation in use.

Additional features and advantages of the invention will be set forth in the description which follows, and in part will be apparent from the description, or may be learned by practice of the invention.

The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a cosmetic brush assembly having a first cylindrical member holding bristles, a second cylindrical member in which the first cylindrical member's lower part is slidably received, and a cap protecting the bristles, including a brush member slidably inserted into the first cylindrical member, and having bristles on its upper end, and a gear connecting member formed on its lower end to join and disjoin a first gear member to a second gear member, and a first coupling boss on its inner middle part, in which the first gear member has first gear teeth on one end and a plurality of first bosses on its outer surface spaced a given distance away from each other, and the second gear member has second gear teeth on one end in mesh with the first gear teeth and a plurality of second bosses on its outer surface spaced a given distance away from each other; a cylindrical catch member fixed onto the lower end portion of the first cylindrical member and having a plurality of inner bosses formed a coupling groove at its lower end portion into which the second boss's tip of the brush member is coupled and a through hole in its lower portion; and a length variable member having both ends each mating with the first coupling boss of the brush member and the second coupling boss of the fixing piece, and variable in length.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of this invention and are incorporated in and constitute apart of this specification, illustrate embodiments of this invention and together with the description serve to explain the principles of the drawings:

DETAILED DESCRIPTION OF PREFERRED EMBODIMENT

Now, reference will be made in detail to the preferred embodiments of the present invention, examples of which are illustrated in the accompanying drawings.

Figure 9:
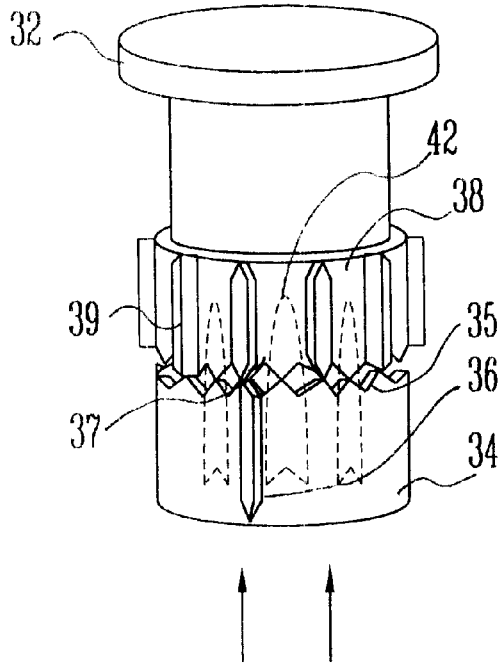
FIG. 9 is a perspective view of the mating state of the first bosses and second bosses of the brush member with respect to the cylindrical catch member before the brush member's bristles are exposed to the outside.
Figure 10:
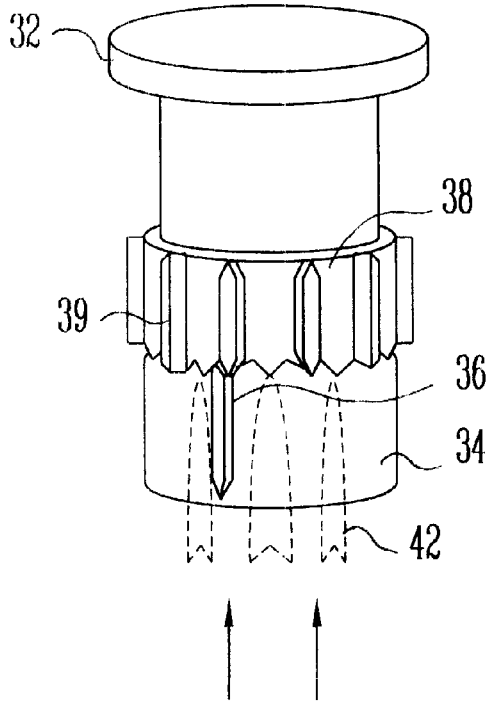
FIG. 10 is a perspective view showing the mating state of the first bosses and second bosses of the brush member with respect to the cylindrical catch member's inner bosses in FIG. 8.
Figure 11:
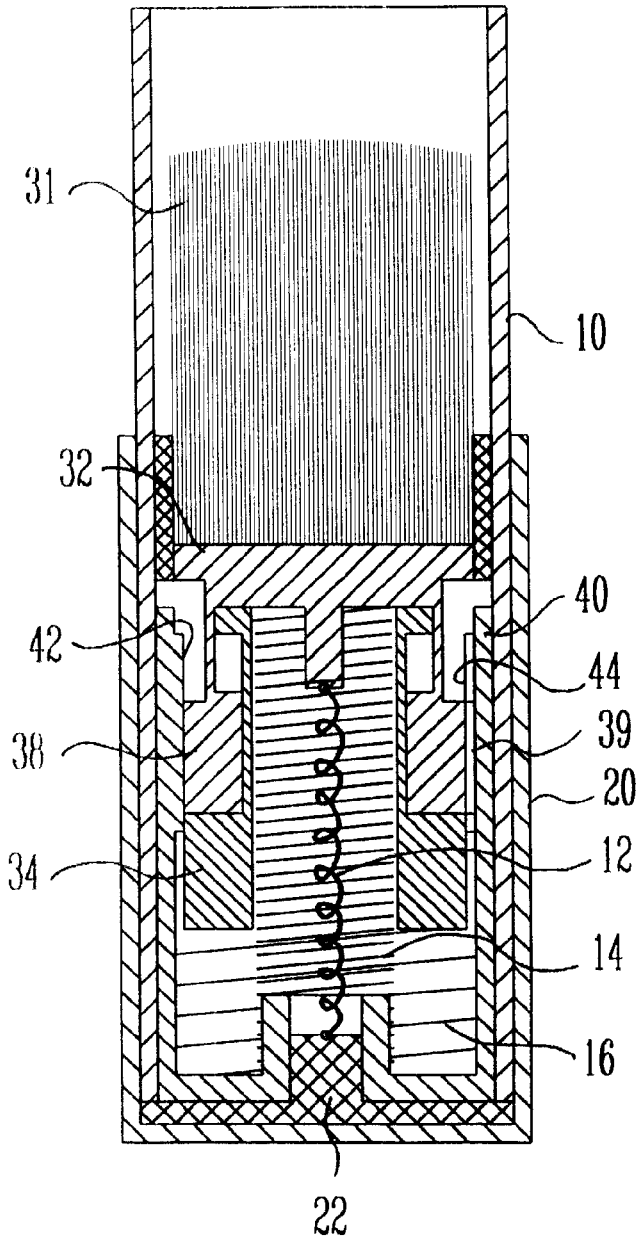
FIG. 11 is a sectional view depicting that a connecting member is joined to the brush member's first coupling boss and the fixing piece's second coupling boss in accordance with a second preferred embodiment of the present invention.
Figure 12:
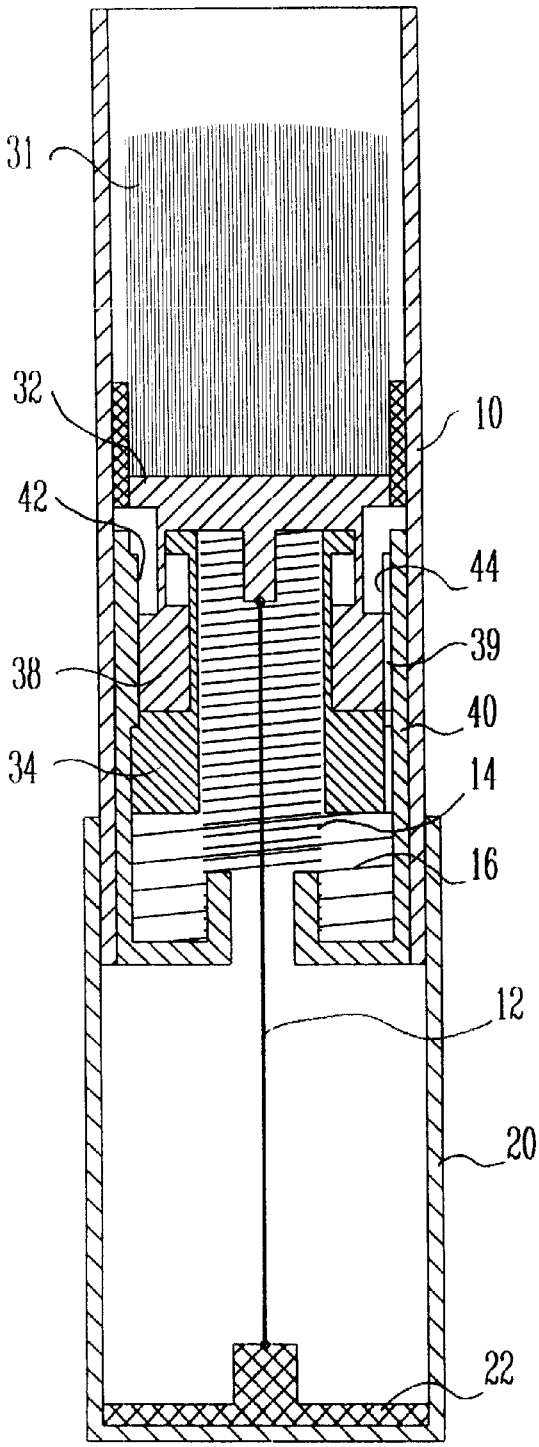
FIG. 12 is a sectional view of the connecting member elongated in accordance with the second preferred embodiment of the present invention.
Figure 13:
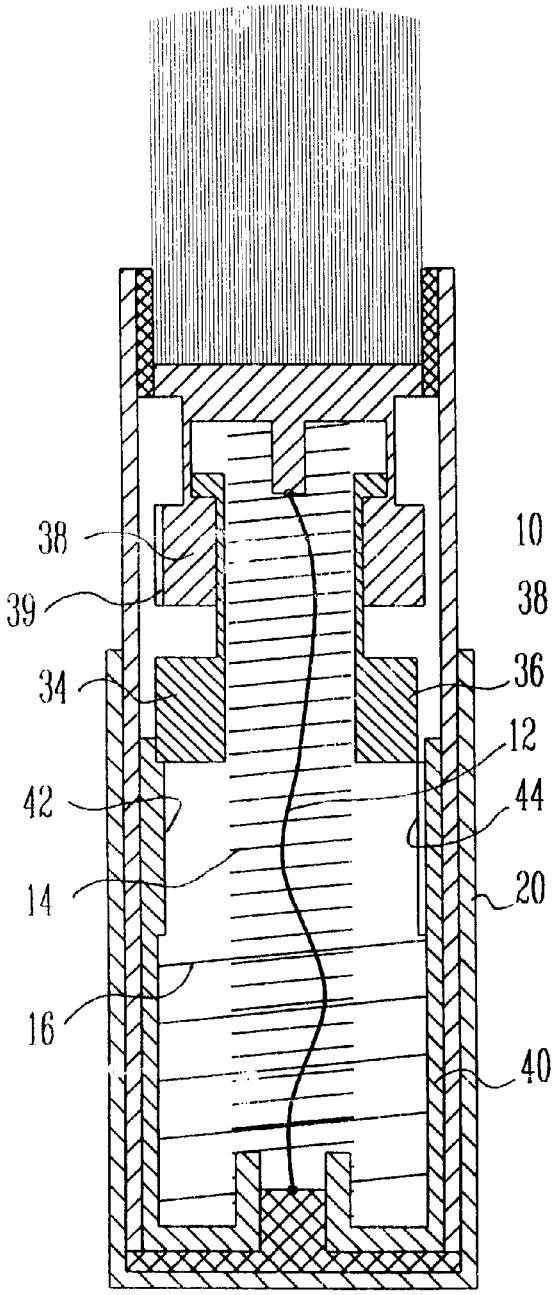
FIG. 13 is a sectional view of the brush member's bristles exposed to the outside in accordance with the second preferred embodiment of the present invention.
Figure 17:
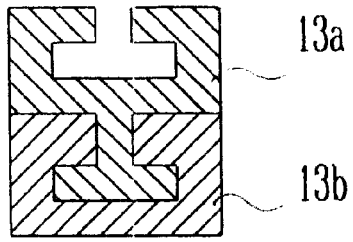
FIG. 17 is a sectional view as taken along line 17—17 of FIG. 15.

FIGS. 1 to 10 depict the operating state of a cosmetic brush assembly in accordance with a first preferred embodiment of the present invention, and FIGS. 11 to 13 depict the operating state of a cosmetic brush assembly in accordance with a second preferred embodiment of the present invention. FIGS. 14 to 17 depict the operating state of a cosmetic brush assembly in accordance with a third preferred embodiment of the present invention.

The inventive brush assembly includes a first cylindrical member 10, a second cylindrical member 20, a brush member 30 having bristles at its end portion, a cylindrical catch member 40 in which the lower portion of the brush member 30 is received, and at least one elastic members 14 and 16 elastically supporting the lower portion of the brush member 30.

The elastic members 14 and 16 and the cylindrical catch member 40 are received in the first cylindrical member 10, and the brush member 30 is slidably received therein. The inventive brush assembly also includes a cap 60 protecting the bristles 31 of the brush member 30 when the brush assembly is not used. In the drawings illustrating the operating state of the inventive brush assembly, the cap 60 is omitted.

(1) First and Second Cylindrical Members 10 and 20

Each of the first and the second cylindrical members is a hollow cylindrical member, and the second cylindrical member 20 is about half of the length of the first cylindrical member 10. A part of the first cylindrical member 10 is slidably received in the second cylindrical member 20. A fixing piece 22, having a second coupling protrusion on its middle portion with which a length variable member's one end mates, is provided to the lower end of the second cylindrical member 20. Thus, the first cylindrical member 10 is opened at one end and closed at the other end.

(2) Brush Member 30

Brush member 30, slidably received in the first cylindrical member 10, has a cylindrical main body 32 having a mounting stage 32*a* on which bristles 31 are mounted and a coupling projection in its middle portion to which the other end of the length variable member whose one end is fixed to the second coupling protrusion of the fixing piece 22 is fixed.

Figure 3:
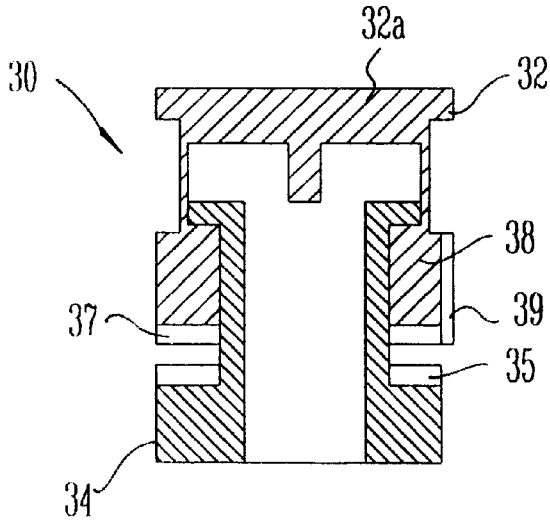
FIG. 3 is a sectional perspective view of a brush member as taken along line 3—3 of FIG. 1.

Main body 32 includes a gear coupling member having a first gear member 38 and a second gear member 34 integrally formed to be spaced a given distance away from each other so as to coaxially turn in the opposite direction of one another. As shown in FIG. 3, the inner diameter of the first gear member 38 is relatively smaller than that of a connecting portion between the first gear member 38 and the mounting end portion 32*a* on which the bristles 31 are mounted. Thus, a given-sized jaw is provided to the upper portion of the first gear member 38, and second gear member 34 has projection on its upper end to mate with the jaw. The projection of the second gear member 34 is slid along the connecting member's inner surface.

Figure 5:
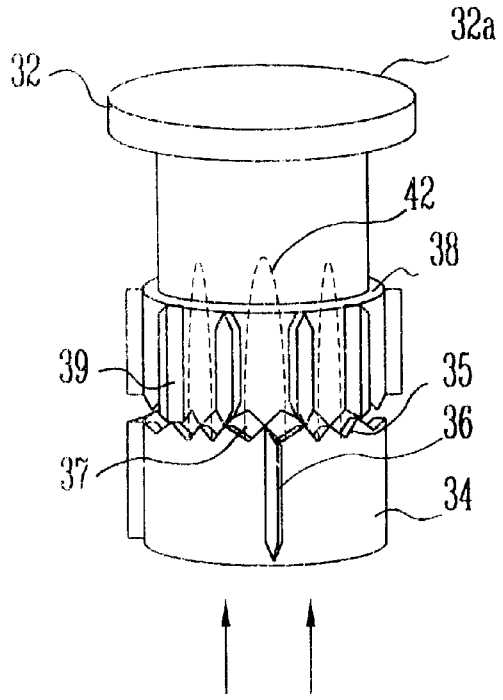
FIG. 5 is a sectional view showing the mating state of first bosses and second bosses of the brush member with respect to the inner bosses of the cylindrical catch member in FIG. 4.

As shown in FIGS. 3 and 5, the first gear member 38 integrally formed with the mounting end portion 32*a* has first gear teeth 37 at one end, and a plurality of 1-shaped first bosses 39 spaced a given distance away from each other on its outer surface. The second gear member 34 has second gear teeth 35 at one end to mesh with the first gear teeth 37 and a plurality of second bosses 36. The first bosses 39 are crossing second bosses 36 by ½ pitch while the first gear teeth are meshing with the second gear teeth 35.

Figure 1:
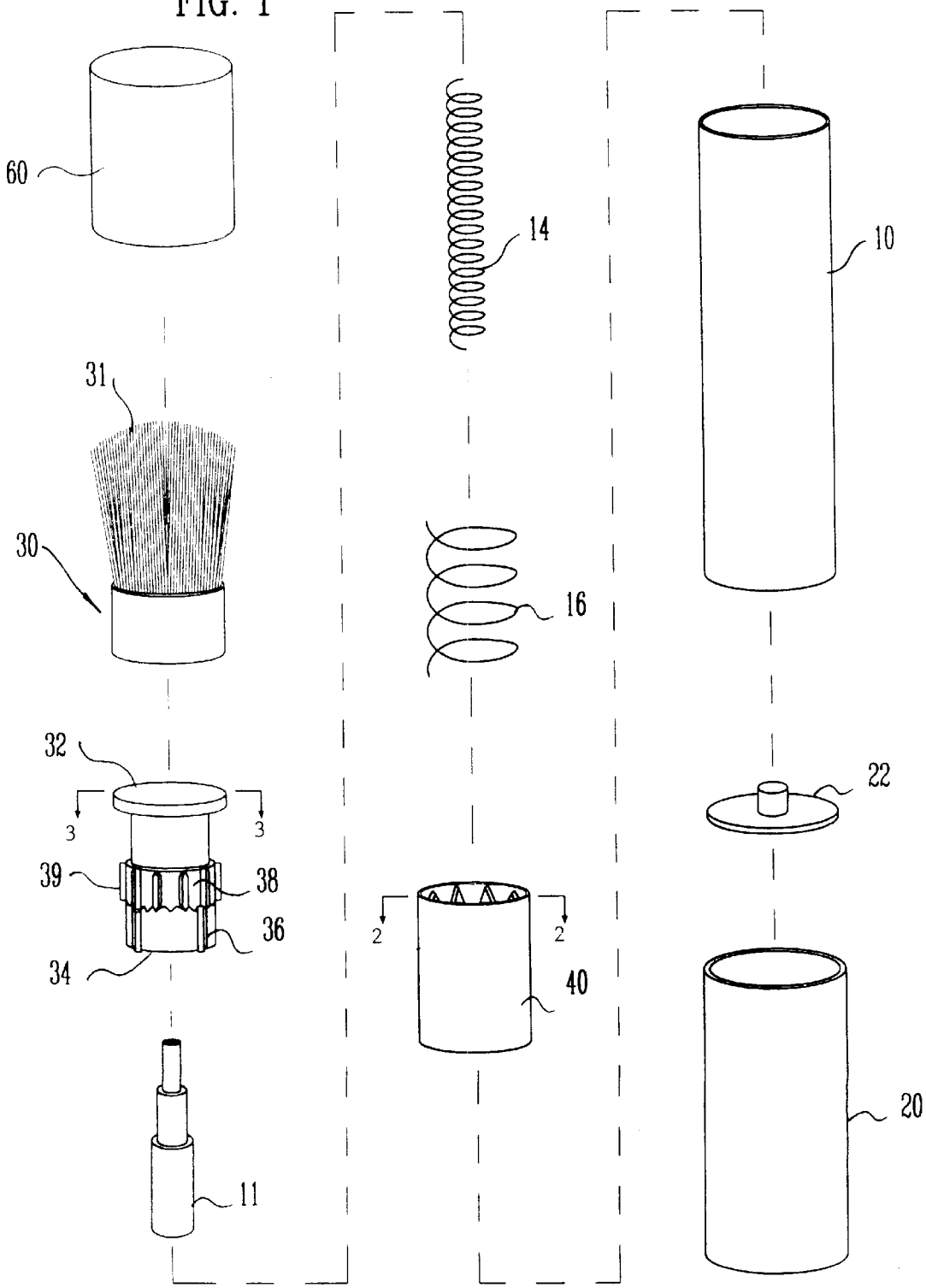
FIG. 1 is an exploded perspective view of each component of a cosmetic brush assembly in accordance with the present invention.
Figure 4:
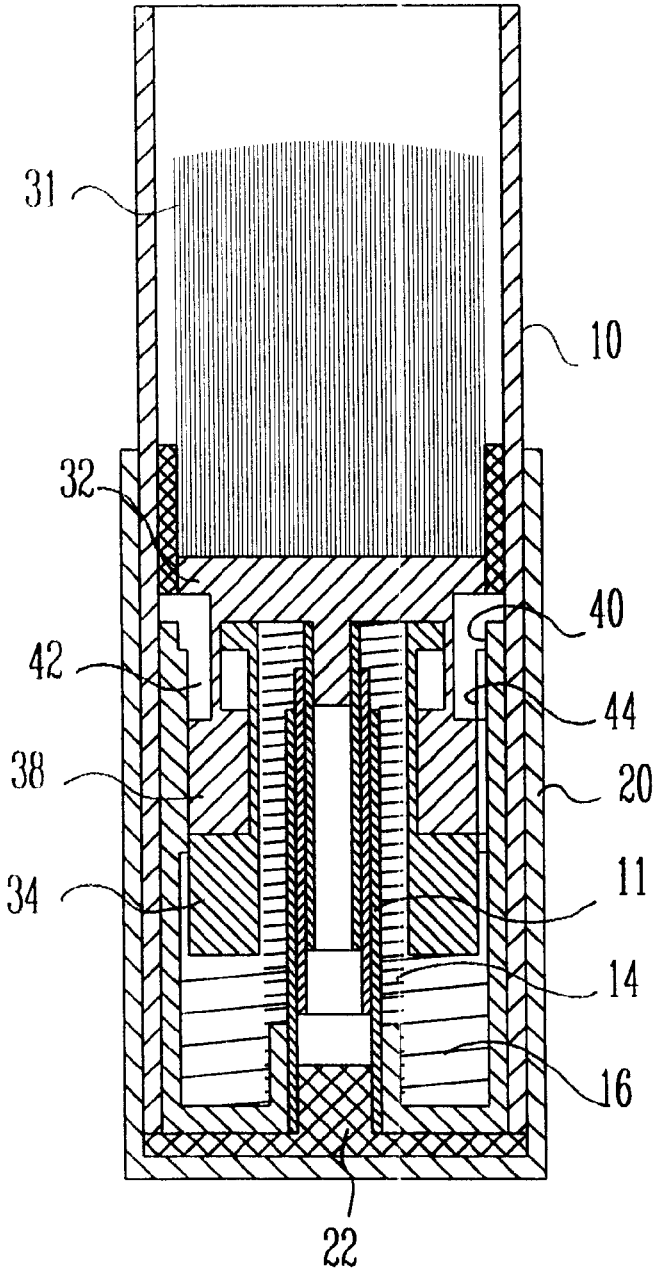
FIG. 4 is a sectional view showing the brush member's bristles inserted into a first cylindrical member in accordance with a first preferred embodiment of the present invention.

As shown in FIGS. 1 and 4, the lower end portion of the brush member 30 is elastically supported by at least one elastic member 14 and 16 such as springs. The first elastic member 14 has one end positioned under the mounting end portion 32*a* of the brush member 30 on which bristles 31 are mounted, and the other end seated on cylindrical member 46 held in the lower section of the cylindrical catch member 40. Accordingly, the first elastic member 14 elastically supports the first gear member 38 integrally formed with the main body 32 of the brush member 30, and the second elastic member 16 elastically supports the second gear member 34.

The first elastic member 14 has the relatively small diameter and the second elastic member 16 has the relatively large diameter.

(3) Cylindrical Catch Member 40

Figure 2:
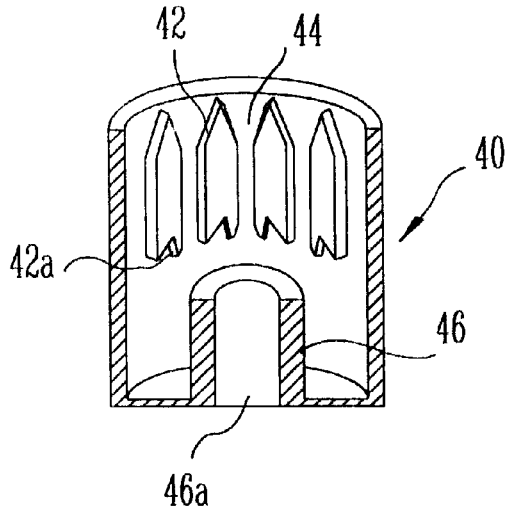
FIG. 2 is a sectional perspective view of a cylindrical catch member as taken along line 2—2 of FIG. 1.

As depicted in FIG. 2, the catch member 40 is a cylindrical body held in the hollow lower section of the first cylindrical member 10, and consists of an upper part having a plurality of inner bosses 42 in its inner surface and a lower part with a flat inner surface. More specifically, the upper part of the catch member 40 includes a plurality of inner bosses 42 each having a coupling groove 42*a* receiving the upper end of first gear member 38. Accordingly, the guide grooves 44 are formed on the inner surface between inner bosses 42 into which first and second bosses are slidably inserted.

The catch member 40 has cylindrical member 46 of a smaller diameter with a through hole 46 via which the length variable member passes in the middle of its lower section. The upper end of the cylindrical member 46 is of a height corresponding to the lower part of the inner bosses 42.

(4) Length Variable Member

The length variable member has both ends end mating with the first coupling boss of brush member 30 and the second coupling boss of fixing piece 22, passing through through hole 46*a* of cylindrical member 46, and has a length that varies with an external force.

Such a length variable member may be either an antenna member 11 of which plural cylindrical unit members are slidably joined to each other, as shown in FIG. 1, or a flexible coupling member 12 such as a string or wire as shown in FIGS. 11 to 13, or a fragmentary coupling member 13 of which a plurality of fragmentary unit members are slidably joined to each other, as depicted in FIGS. 14 to 17.

The following description relates to the operating state of the cosmetic brush assembly in accordance with the first preferred embodiment of the present invention.

The initial case where the cosmetic brush assembly is not used will be first described, and since the protecting cap (60 in FIG. 1) is simply joined to the upper part of the first cylindrical member 10, the cap will not be illustrated in the following drawings and the description thereabout will be omitted.

Referring to FIG. 4, the lower part of the first cylindrical member 10 is received in the second cylindrical member 20, and the lower end of the first cylindrical member 10 comes in contact with the fixing piece 22 positioned on the lower end of the second cylindrical member 20.

As depicted in FIG. 5, while the first gear member 38 and the second gear member 34 are being held in the cylindrical catch member 40, plural first bosses 39 of the first gear member 38 are each seated in the guide grooves 44 between the inner bosses 42 of the cylindrical catch member 40 (indicated by the dotted line for convenience sake) and each of second bosses 36 of the second gear member 34 is positioned in the inner lower part of the catch member 40 with its upper end inserted in each coupling groove 42*a* provided to the lower end of the inner bosses 42. The first bosses 39 and the second bosses 36 are spaced by ½ pitch away from each other.

As described above, since the upper end of respective second bosses 36 of the second gear member 34 mates with the coupling groove 42*a* of the inner bosses 42, the brush member 30, elastically supported by the first and the second elastic members in the direction of the arrow, is protruded upward, and the gear threads of the first gear teeth 37 contacts with the gear threads of the second gear teeth 35.

The unit members of the antenna member 11 serving as the length variable member are folded while both ends of the antenna member 11 are each mating with the first coupling boss of the brush member 30 and the second coupling boss of the fixing piece 22 whereby the antenna member 11 is maintained in its minimum length. The bristles 31 provided on the upper end portion of the brush member 30 are completely inserted into the first cylindrical member 10.

Figure 6:
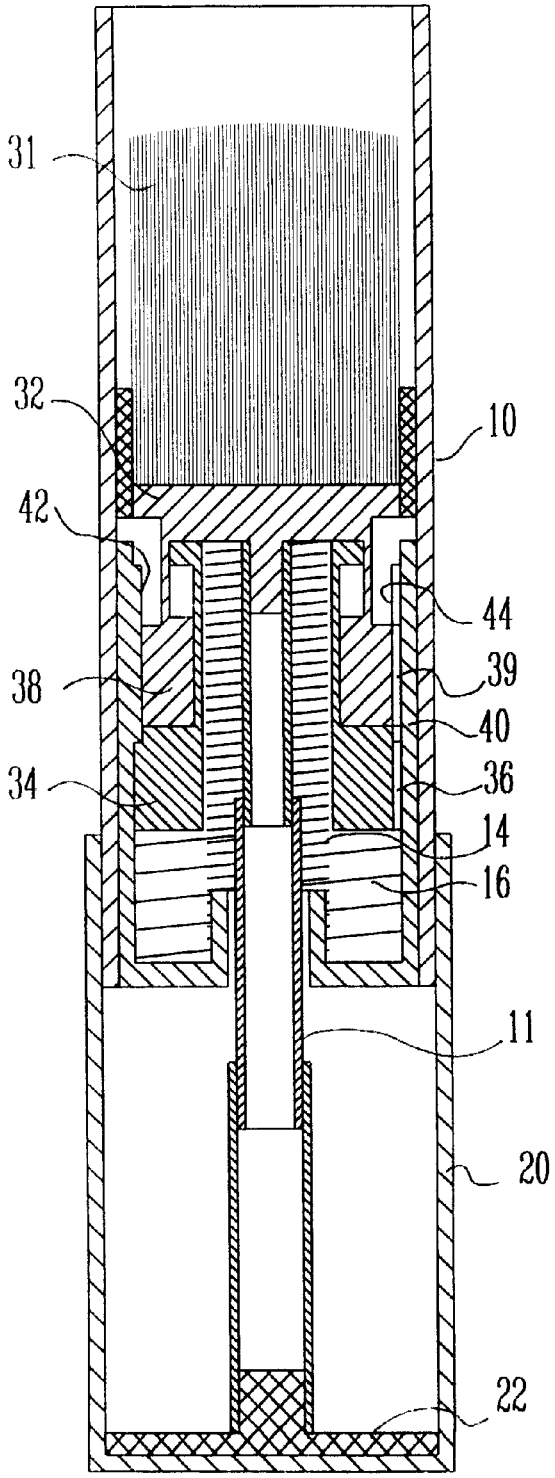
FIG. 6 is a sectional view of a second cylindrical member moved downward in accordance with the preferred embodiment of the present invention.
Figure 8:
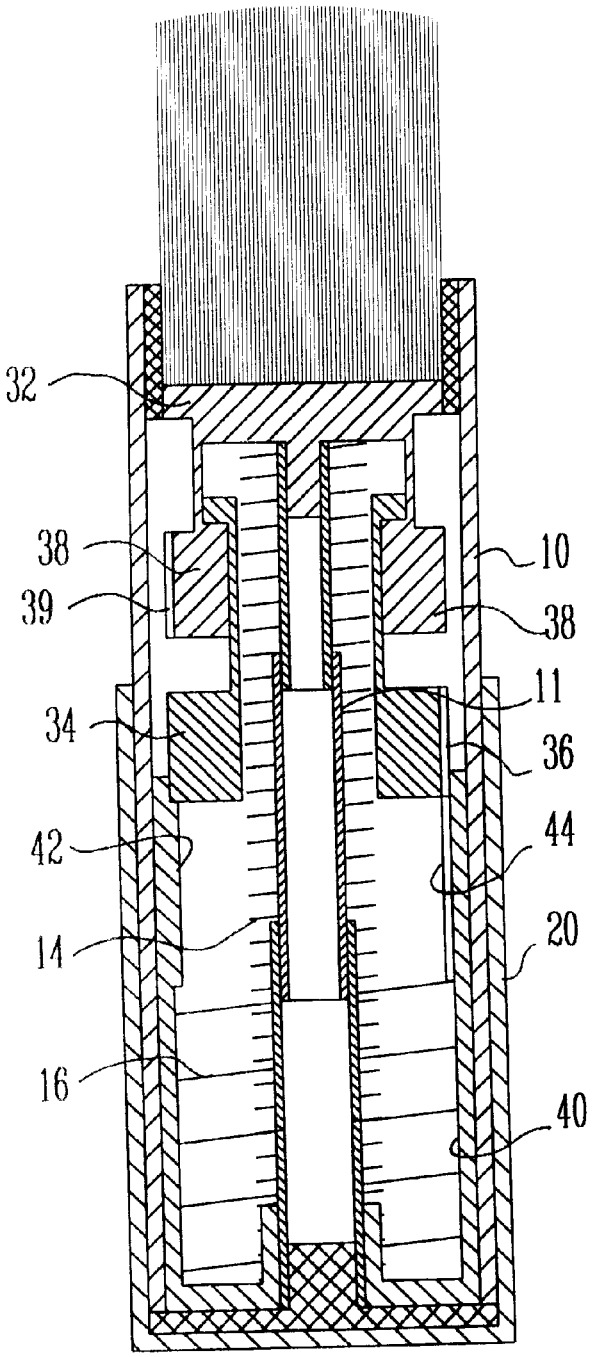
FIG. 8 is a sectional view of the brush member's bristles exposed to the outside in accordance with the preferred embodiment of the present invention.

In order to expose the bristles 31 of the brush member 30 from the first cylindrical member 10, as depicted in FIG. 6, a user draws the second cylindrical member 20 downward from the first cylindrical member 10.

Figure 7:
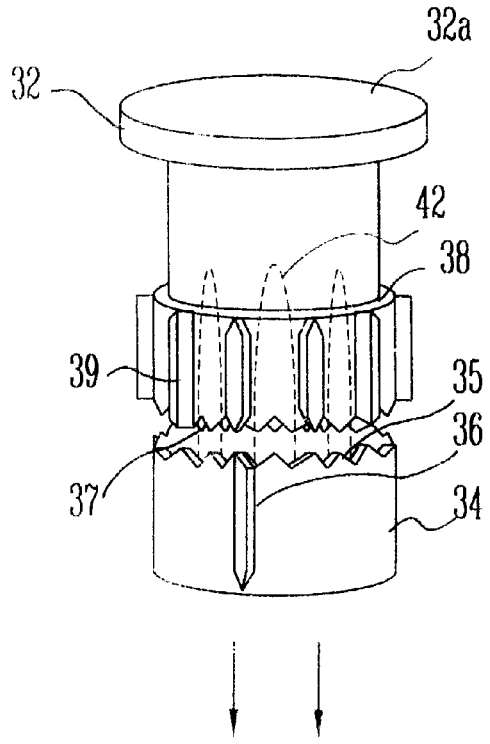
FIG. 7 is a sectional view showing the mating state of the first bosses and second bosses of the brush member with respect to the cylindrical catch member's inner bosses in FIG. 6.

As indicated by the arrow in FIG. 7, the force exerts downward to release the gear threads of the first gear teeth 37 from the gear threads of the second gear teeth 35, and the lower end of the respective first bosses 39 contacts the upper end of each second boss 36 and the gear threads of the first gear teeth 37 come in contact with those of the second gear teeth 35 while the second gear member 34 is horizontally moved ½ pitch by the second spring.

Antenna member 11 is extended in maximum length with its unit members completely drawn out. Since the extended length of antenna member 11 is fixed, even if the first cylindrical member 10 is drawn out upward, the first cylindrical member 10 is not totally separated from the second cylindrical member 20. That is, a lower part of the first cylindrical member 10 is held in the second cylindrical member 20. Particularly, the brush member 30 is prevented from being totally removed from the second cylindrical member 20.

Since the cylindrical catch member 40 is being fixed to the lower part of the first cylindrical member 10, the elastic members 14 and 16 elastically supporting the lower end of the brush member 30 are being compressed between the lower end portion of the brush member 30 and the inner lower section of the cylindrical catch member 40 while the second cylindrical member 20 is drawn out downward.

Thereafter, when the drawing action for the second cylindrical member 20 is stopped, the brush member 30 is drawn out upward by the elastic force of the elastic member 14, and the antenna member 11 having one end mating with the first coupling boss of the brush member 30 comes to move upward. Simultaneously with this, while the fixing piece 22 having the second coupling boss mating with the other end of the antenna member 11 is moved upward, the second cylindrical member 20 is moved upward until the lower end portion of the first cylindrical member 10 comes in contact with the upper surface of the fixing piece 22.

The antenna member 11 is kept in the completely extended state and elastic members 14 and 16 are being completely extended, whereby the bristles 31 of the brush member 30 are being exposed to the outside from the first cylindrical member 10.

As mentioned above, the following description concerns the meshing state of the gear members 38 and 34 while the brush member 30 is moved upward by the elastic force of the elastic members 14 and 16.

Referring to FIG. 9, once the elastic force of the elastic members 14 and 16 exerts upward, as indicated by the arrow, the first bosses 39 of the first gear member 38 and the second bosses 36 of the second gear member 34 are each positioned in the guide grooves 44 between the inner bosses 42 of the cylindrical catch member 40. At this point, the first gear threads 37 of the first gear member 38 and the second gear teeth 35 of the second gear member 34 are contacting each other. The lower end of first bosses 39 also comes in contact with the upper end of second bosses 36.

After that, as depicted in FIG. 10, the first bosses 39 of the first gear member 38 are each separated from the guide grooves 34 of the cylindrical catch member 40 while the bristles 31 of the brush member 30 are exposed to the outside, i.e. elastic member 14 is completely extended. The second bosses 36 of the second gear member 34 are each seated in the guide grooves 34.

In the above-described state, the first gear teeth 37 of the first gear member 38 are in mesh with the second gear teeth 35 of the second gear member 34. Since the elastic member 14 is only completely elongating, the elastic force of the elastic member 14 acts on the brush member 30 relatively small.

In order to insert the bristles 31 of the brush member 30 into the first cylindrical member 10 after using it, first, a user moves the second cylindrical member 20 down. At this time, the antenna member 11 is pulled down in response to the moving down of the second cylindrical member 20, and the bristles 31 come to be inserted into the first cylindrical member 10.

As mentioned above, the meshing state of the gear members 38 and 34 is maintained.

That is, since the first gear member 38 is turned by ½ pitch with respect to the second gear member 34, the second boss's upper end of the second gear member 34 is seated in the coupling groove 42*a* of each of inner bosses 42, thereby preventing the brush member 30 from being moved upward by the elastic members 14 and 16.

Referring to FIGS. 11 and 13, another preferred embodiment of the present invention will be described as follows, and like reference numerals denote like reference parts throughout the specification and the drawings.

Referring first to FIG. 11, a flexible coupling member 12 such as a string or wire is used as a length variable member. That is, while the bristles 31 are held in the first cylindrical member 10 and the lower part of first cylindrical member 10 is completely inserted into the second cylindrical member 20, the flexible coupling member 12 does not come to elongate.

As shown in FIG. 12, when the second cylindrical member 20 is moved downward, although the flexible coupling member 12 comes to elongate completely, the elastic members 14 and 16 is maintained to be compressed. As shown in FIG. 13, after the second cylindrical member 20 is completely moved downward, the brush member 30 is moved upward by the elastic members 14 and 15, and the bristles 31 are exposed to the outside. The flexible coupling member 12 elongates a little.

With reference to FIGS. 14 to 17, another preferred embodiment of the present invention will be described as follows, and like reference numerals denote like reference parts throughout the specification and the above drawings.

In this embodiment, the construction and operation of the present invention are similar to those of the above-described embodiments except that the fragmentary coupling member 13 is used as the length variable member. This fragmentary coupling member 13 of FIG. 17 includes a second fragmentary member 13*b* with a recess on its one side, and a first fragmentary member 13*a* having a first projection on one side to be slidably inserted in the recess of member 13*b*, and a second recess on the other side. The fragmentary coupling member 13 further includes a fragmentary member having a projection slidably inserted into an adjacent fragmentary member's recess.

Figure 14:
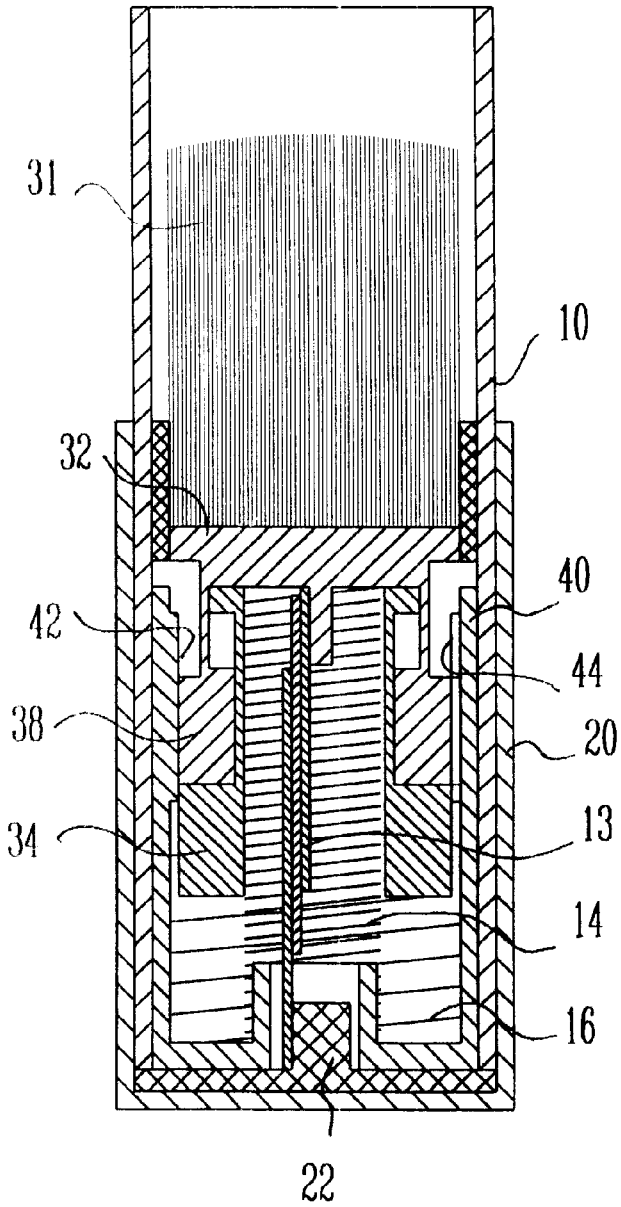
FIG. 14 is a sectional view of the brush member's bristles housed in the first cylindrical member in accordance with a third preferred embodiment of the present invention.
Figure 15:
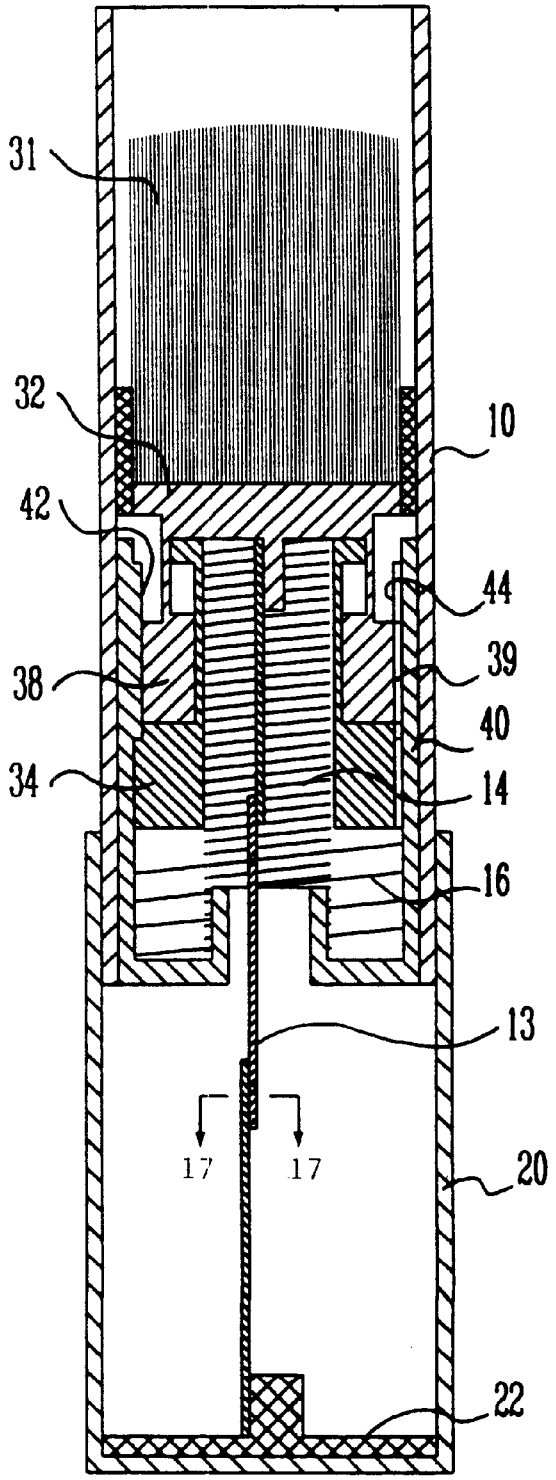
FIG. 15 is a sectional view of the connecting member elongated in accordance with the third preferred embodiment of the present invention.
Figure 16:
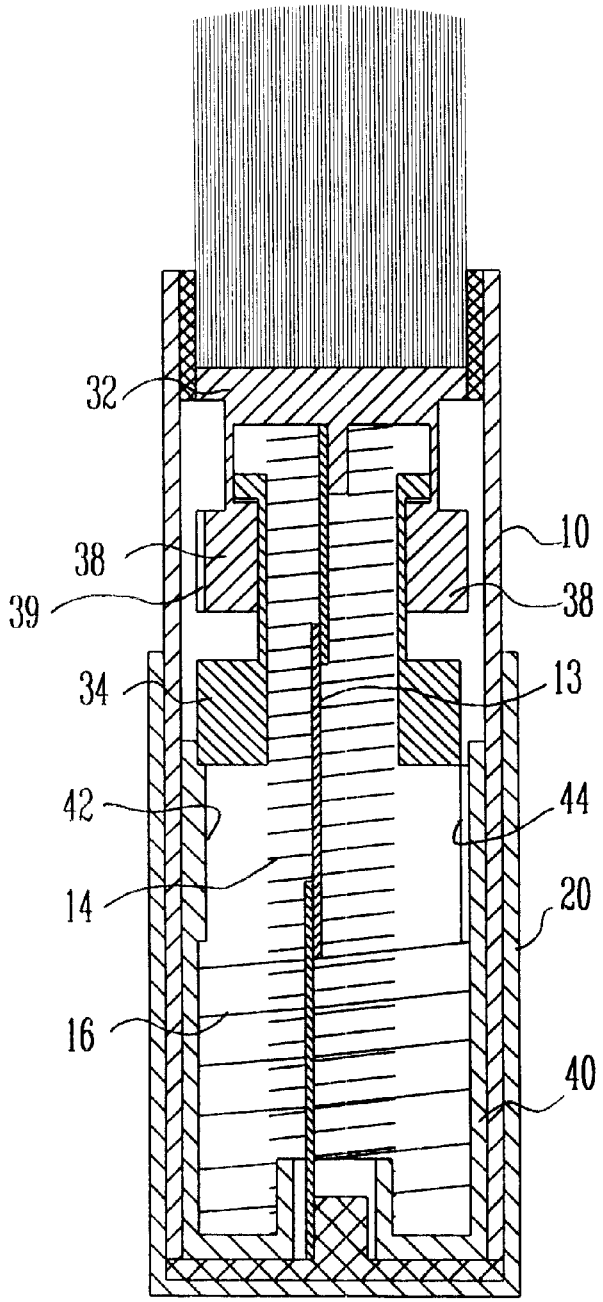
FIG. 16 is a sectional view of the brush member's bristles exposed to the outside in accordance with the third preferred embodiment of the present invention.

As depicted in FIG. 14, the fragmentary members of the fragmentary coupling member 13 are folded together while the brush member 30 is held in the first cylindrical member 10 and the lower part of the first cylindrical member 10 is inserted into the second cylindrical member 20.

The fragmentary members are drawn out of the adjacent fragmentary members to make fragmentary coupling member 13 elongate maximally while the second cylindrical member 20 is moved downward and the elastic members 14 and 16 are being compressed.

The elastic members 14 and 16 completely elongate and the fragmentary coupling member 13 is maintained in minimum length with its fragmentary members folded while the brush member 30 is exposed to the outside and the lower part of the first cylindrical member 10 is held in the second cylindrical member 20.

As described above, the bristles of the brush member inserted into the first cylindrical member can be easily exposed to the outside, and particularly, the brush member can be taken out and used for various purposes without changing the overall length of the cylindrical members, thus enhancing the convenience in use.

The above description is about the cosmetic brush assembly by way of an example, and the inventive concept may be applied to rip stick cylindrical members, etc. and attains the same advantages.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A cosmetic brush assembly having a first cylindrical member holding bristles, a second cylindrical member into which a lower part of the first cylindrical member is slidably received, and a cap protecting the bristles, the brush assembly comprising:

a brush member slidably inserted into the first cylindrical member, and having the bristles on an upper end, and a gear connecting member integrally formed on a lower end to separably join a first gear member to a second gear member, and a first coupling boss on an inner middle part, said first gear member having first gear teeth on one end and a plurality of first bosses on an outer surface spaced a given distance away from each other, and said second gear member having second gear teeth on one end in mesh with the first gear teeth and a plurality of second bosses on an outer surface spaced a given distance away from each other;

a cylindrical catch member fixed onto the lower end portion of the first cylindrical member and having a plurality of inner bosses forming a coupling groove at a lower end portion into which the second boss's tip of the brush member is coupled having and a through hole in a lower portion;

a fixing piece that is fixed to a lower end portion of the second cylindrical member and having a second coupling boss on a middle portion; and a length variable member having a first end and second end each mating with the first coupling boss of the brush member and the second coupling boss of the fixing piece, and variable in length.

2. A cosmetic brush assembly according to claim 1, wherein the cylindrical catch member has at least one elastic member for elastically supporting a lower part of the second gear member.

3. A cosmetic brush assembly according to claim 2, wherein each elastic member includes a first elastic body for elastically supporting the first gear member and a second elastic body for elastically supporting the second gear member.

4. A cosmetic brush assembly according to claim 2, wherein the length variable member is an antenna member having a plurality of cylindrical unit members slidably folded together.

5. A cosmetic brush assembly according to claim 2, wherein the length variable member is a flexible coupling member.

6. A cosmetic brush assembly according to claim 2, wherein the length variable member is a fragmentary coupling member having a plurality of fragmentary units slidably folded together.

7. A cosmetic brush assembly according to claim 2, wherein guide grooves are formed between the inner bosses of the cylindrical catch member to lead sliding of the first gear member's first bosses and the second gear member's second bosses, and as one end of each second boss mates with the coupling groove of each of the inner bosses, the brush member mounted on the first gear member is inserted into the first cylindrical member, and the second bosses are each moved upward along the guide grooves, thus exposing the bristles of the brush member to the outside.

8. A cosmetic brush assembly according to claim 7, wherein after the first gear member's first bosses and the second gear member's second bosses are moved downward along the guide grooves by moving the second cylindrical member downward, while the brush member's bristles are being exposed to the outside, one end of each of the second gear member's second bosses mates with the coupling groove provided to each inner boss's lower end, whereby the brush member's bristles are inserted into the first cylindrical member.

9. A cosmetic brush assembly according to claim 8, wherein as the second gear member's second bosses slide to the lower portion of each coupling groove, the second gear member is turned by ½ pitch with respect to the first gear member to either insert the second bosses into the respective coupling races or release the second bosses therefrom.

10. A cosmetic brush assembly according to claim 7, wherein as the second gear member's second bosses slide to the lower portion of each coupling groove, the second gear member is turned by ½ pitch with respect to the first gear member to either insert the second bosses into the respective coupling races or release the second bosses therefrom.

* * * * *